United States Patent [19]

Hirano et al.

[11] 4,255,511

[45] Mar. 10, 1981

[54] DIRECT POSITIVE SILVER HALIDE LIGHT-SENSITIVE MATERIAL

[75] Inventors: Shigeo Hirano; Keiichi Adachi; Nobuyuki Tsujino, all of Minami-ashigara, Japan

[73] Assignee: Fuji Photo Film Co., Ltd., Ashigara, Japan

[21] Appl. No.: 26,962

[22] Filed: Apr. 4, 1979

[30] Foreign Application Priority Data

Apr. 6, 1978 [JP] Japan ..... 53/40621

[51] Int. Cl.[3] ..... G03C 1/06; G03C 7/00; G03C 1/76; G03C 1/36

[52] U.S. Cl. ..... 430/217; 430/223; 430/226; 430/505; 430/559; 430/560; 430/570; 430/580; 430/581; 430/591; 430/592; 430/598; 564/27

[58] Field of Search ..... 96/64, 95; 260/552 R; 430/217, 223, 226, 230, 505, 559, 560, 570, 580, 581, 591, 592, 598

[56] References Cited

U.S. PATENT DOCUMENTS 3,227,550 1/1966 Whitmore et al. ..... 96/3

4,030,925 6/1977 Leone et al. ..... 96/95

4,080,207 3/1978 Leone et al. ..... 96/64

*Primary Examiner*—Won H. Louie, Jr.

*Attorney, Agent, or Firm*—Sughrue, Rothwell, Mion, Zinn and Macpeak

[57] ABSTRACT

A direct positive light-sensitive silver halide photographic material comprising a support having thereon a layer containing a compound represented by the formula (I):

$$R_1NH-\underset{\underset{S}{\|}}{C}NH-X_1-Y-CONH-X_2-NHNH\overset{\overset{O}{\|}}{C}-R_2 \quad (I)$$

wherein $R_1$ represents an aliphatic residue or an aromatic residue; $R_2$ represents a hydrogen atom, an aliphatic residue, or an aromatic residue; $X_1$ and $X_2$, which may be the same or different, each represents a divalent aromatic residue; and Y represents —R—, —O—R or —S—R— wherein R represents a divalent aliphatic residue and the O or S is bonded to $X_1$. The compound is particularly effective in combination with a diffusible dye releasing dye image providing compound having an o-hydroxyarylsulfamoyl group.

37 Claims, No Drawings

DIRECT POSITIVE SILVER HALIDE LIGHT-SENSITIVE MATERIAL

BACKGROUND OF THE INVENTION

1. Field of the Invention

The present invention relates to a silver halide photographic light-sensitive material by which direct positive photographic images are formed, and more particularly, to a photographic light-sensitive material, whose photographic emulsion layers or other hydrophilic colloid layers contain a novel compound as a fogging agent.

2. Description of the Prior Art

In the field of silver halide photography, a technique in which positive photographic images are obtained without going through negative images or intermediate processing producing negative images is called direct positive photography, and photographic light-sensitive materials and photographic emulsions using such a photographic technique are called direct positive light-sensitive materials and direct positive photographic emulsions, respectively.

A variety of direct positive photographic techniques are known. The most useful methods are methods in which silver halide grains which have previously been fogged are exposed to light in the presence of a desensitizer followed by development, and methods comprising exposing a silver halide emulsion containing silver halide grains having light-sensitive specks mainly inside the silver halide grains to light and then developing the exposed emulsion in the presence of a fogging agent. The present invention relates to the latter technique. Silver halide emulsions possessing light-sensitive specks in the inside of the silver halide grains and forming latent images mainly inside the grains are referred to as internal latent image type silver halide grains and thus distinguished from silver halide grains which form latent images mainly on the surface of the grains.

A method for obtaining direct positive images by surface-developing an internal latent image type silver halide photographic emulsion in the presence of a fogging agent, and photographic emulsions and photographic light-sensitive materials employed for such a method are disclosed in U.S. Pat. Nos. 2,456,953, 2,497,875, 2,497,876, 2,588,982, 2,592,250, 2,675,318 and 3,227,552, British Pat. Nos. 1,011,062 and 1,151,363, Japanese Pat. No. 29,405/1968, etc.

In the internal latent image type method for obtaining direct positive images, the fogging agent can be incorporated into a developing solution, however, by incorporating the fogging agent into photographic emulsion layers or associated layers of the light-sensitive material and thereby adsorbing it onto the surface of the silver halide grains, better reversal characteristics can be obtained.

As fogging agents which are employed in the above-described method for obtaining direct positive images, there are hydrazine and derivatives thereof as described in U.S. Pat. Nos. 2,563,785, 2,588,982 and 3,227,552, respectively. In particular, U.S. Pat. No. 3,227,552 discloses that hydrazide and hydrazine type compounds which are derivatives of hydrazine can be incorporated not only in developing solution but also in light-sensitive layers.

However, when hydrazine compounds are incorporated into the emulsion layer, the compounds must be employed in a considerably high concentration (e.g., about 2 g per mol of silver), and in addition, because the fogging agent is transferred from the emulsion layer to the developing solution during development processing, the concentration of the fogging agent in the emulsion varies and unevenness in the maximum density results (at the non-exposed areas), i.e., the fogging effect becomes non-uniform, in the case of multilayer color light-sensitive material, among the emulsion layers.

Furthermore, it is known that these fogging agents evolve nitrogen gas during fogging. This gas gathers in a film to form gas bubbles, which sometimes imparts unexpected damage to photographic images.

In order to avoid these shortcomings, fogging agents comprising heterocyclic quaternary salt compounds described in U.S. Pat. Nos. 3,615,615, 3,719,494, 3,734,738 and 3,759,901, Japanese patent application (OPI) Nos. 3426/1977 and 69613/1977 (The term "OPI" as used herein refers to a "published unexamined Japanese patent application") have been used.

However, in most cases, sensitizing dyes are incorporated into the silver halide emulsion for spectral sensitization, and particularly in color light-sensitive materials, layers which are respectively sensitive to both green light and red light in addition to a layer sensitive to blue light are essentially required and emulsions in the green sensitive layer and red sensitive layer necessarily contain sensitizing dyes. In direct positive emulsions, where fogging agents are contained together with sensitizing dyes sensitive to green light and red light, competitive adsorption in the silver halide emulsion occurs between the sensitizing dyes and the quaternary salt fogging agent. If a fogging agent in an amount sufficient to form the fogging centers is incorporated into the emulsion, spectral sensitization is prevented. On the other hand, if a spectrally sensitizing dye in a concentration sufficient to obtain desired spectral sensitization is incorporated into the emulsion, the formation of the fogging center is prevented.

One means for overcoming this disadvantage, wherein a sensitizing dye having a nucleating substituent in the dye molecule is employed, is disclosed in U.S. Pat. No. 3,718,470.

However, when nucleating activity as well as spectrally sensitizing activity are simultaneously imparted to one molecule, the use of the dye in an appropriate amount for the spectral sensitization is insufficient for the nucleating activity, and on the other hand, the use of the dye in an amount sufficient for the nucleating activity is inappropriate for the spectral sensitization.

In addition, a disadvantage which is common to the hydrazine type compounds and heterocyclic quaternary salt compounds is their large temperature-dependency for the nucleating activity. That is, if the developing temperature is low, the lower in the nucleating activity, and if the developing temperature is high, the sensitivity is reduced.

In order to eliminate this disadvantage, it has been proposed in U.S. Pat. No. 4,030,925 (corresponding to German patent application (OLS) No. 2,635,316) and U.S. Pat. No. 4,031,127 (corresponding to German patent application (OLS) No. 2,635,317) that acyl hydrrazinophenylthiourea compound be employed.

However, in this field of art, it has long been desired to develop more improved fogging agents having less temperature-dependency (upon processing) with direct positive system not only using the p-hydroxyarylsulfonamide type dye image-providing materials as described in the aforementioned U.S. patents but also using dye image-providing materials different therefrom.

SUMMARY OF THE INVENTION

Accordingly, a first object of the present invention is to provide a direct positive light-sensitive material capable of providing uniform maximum density.

A second object of the present invention is to provide a direct positive photographic light-sensitive material containing a fogging agent (nucleating agent) which imparts a desired fogging (nucleating) activity without detracting from spectral sensitization.

A third object of the present invention is to provide a direct positive photographic light-sensitive material in which adequate spectral sensitization is provided and direct positive images having uniform and high maximum density are produced.

A fourth object of the present invention is to provide a direct positive photographic light-sensitive material which does not contaminate the developing solution.

A fifth object of the present invention is to provide a direct positive photographic light-sensitive material having less dependency upon the developing temperature.

A sixth object of the present invention is to provide a color diffusion transfer photographic light-sensitive material which has the aforementioned various properties.

DETAILED DESCRIPTION OF THE INVENTION

The aforementioned objects of the present invention are achieved by incorporating a fogging agent represented by the formula (I) set forth below into at least one hydrophilic colloid layer in a silver halide light-sensitive material, preferably an internal latent image type silver halide photographic emulsion layer or an adjacent hydrophilic colloid layer:

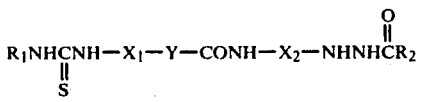

(I)

wherein $R_1$ represents an aliphatic residue or an aromatic residue; $R_2$ represents a hydrogen atom, an aliphatic residue or an aromatic residue; $X_1$ and $X_2$, which may be the same or different, each represents a divalent aromatic residue; and Y represents —R—, —O—R— or —S—R— wherein R represents a divalent aliphatic group.

In more detail, the aliphatic residue for $R_1$ and $R_2$ includes a substituted or unsubstituted straight chain, branched chain or cyclic alkyl group. The straight chain and branched chain alkyl group for $R_1$ is an alkyl group having 1 to 10 carbon atoms and preferably 1 to 8 carbon atoms. Specific examples thereof include a methyl group, an ethyl group, an isobutyl group, a t-octyl group, etc. The alkyl group for $R_2$ comprises, for example, 1 to 6 carbon atoms, e.g., a methyl group, an ethyl group, a propyl group, etc.

Further, the cycloalkyl group for $R_1$ and $R_2$ comprises, for example, 3 to 10 carbon atoms; specific examples thereof including a cyclopropyl group, a cyclohexyl group, an adamantyl group, etc.

Examples of the substituents for the alkyl group $R_1$ and $R_2$ include an alkoxy group having 1 to 6 carbon atoms (e.g., a methoxy group, an ethoxy group, a propoxy group, a butoxy group, etc.), a halogen atom (e.g., chlorine, bromine, fluorine and iodine), and an aryl group having 6 to 10 carbon atoms (e.g., a phenyl group, a p-chlorophenyl group, a p-methylphenyl group, etc.). Specific examples of the substituted alkyl groups for $R_1$ and $R_2$ are, for example, a 3-methoxypropyl group, a 4-chlorocyclohexyl group, a benzyl group, a p-methylbenzyl group and a p-chlorobenzyl group.

Further, the alkenyl group for $R_1$ and $R_2$ comprises, for example, 2 to 6 carbon atoms; specific examples thereof include an allyl group, a 2-butenenyl group, 2-pentenyl group, etc.

On the other hand, the aromatic residues for $R_1$ and $R_2$ include a substituted or unsubstituted phenyl group and a substituted or unsubstituted naphthyl group. Examples of the substituents for these substituted aryl groups include an alkyl group having 1 to 6 carbon atoms, an alkoxy group having 1 to 6 carbon atoms, and a halogen atom, etc. Specific examples of the substituted aryl group for $R_1$ and $R_2$ include, e.g., a p-methoxy-phenyl group, a tollyl group, a p-chlorophenyl group and an m-fluorophenyl group.

The divalent aromatic residues for $X_1$ and $X_2$ include a substituted or unsubstituted phenylene group and a naphthylene group. Examples of the substituents for the substituted phenylene group for $X_1$ and $X_2$ include an alkyl group having 1 to 6 carbon atoms (e.g., a methyl group, etc.), and a halogen atom (e.g., chlorine, etc.), etc. Of the $X_1$ and $X_2$ groups defined above, a phenylene group is the most preferred. In other words, the connecting group formed between the

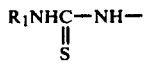

group and the

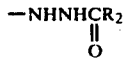

group is preferably

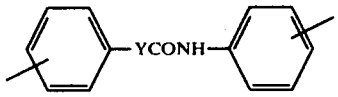

More specifically, the

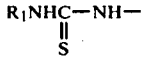

group is connected to the

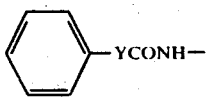

group at the meta or para position, and the

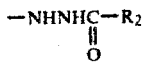

group is connected with the

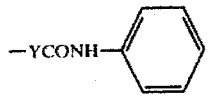

group
at the meta or para position thereof.

The connecting group for Y is represented by —R—, —O—R or —S—R—, and the O and S atom therein is bonded to the residue represented by $X_1$. R represents a divalent aliphatic group and includes a straight chain, branched chain or cyclo alkylene group and further includes a group containing a double bond or a triple bond besides a saturated bond.

Examples of the straight chain and branched chain alkylene groups for R include an alkylene group having 1 to 5 carbon atoms and preferably 1 to 3 carbon atoms.

Specific examples thereof are, for example, $—CH_2—$, $—CH_2CH_2—$, $—CH_2CH_2CH_2—$, $—CH(CH_3)—$, $—CH(CH_2CH_3)—$, etc. Examples of the cyclo alkylene groups for R include a cyclo alkylene group having 3 to 6 carbon atoms. Specific examples thereof are a 1,2-cyclopropylene group, a 1,4-cyclohexylene group, etc. Specific examples of the groups containing an unsaturated bond contain 2 to 6 carbon atoms and include —CH=CH—, —C≡C—, etc.

When the fogging agent of the present invention is employed, the following various effects are obtained.

(1) The temperature-dependency of processing is less.

(2) No deterioration of images due to evolution of nitrogen gas is encountered.

(3) The amount of the fogging agent employed is reduced.

(4) Adsorption capability of the silver halide is strong so that fogging activity effectively occurs. (The amount of fogging agent employed may be reduced and, thus, spectral sensitization is not damaged.)

(5) Visible light is not absorbed such that no desensitization is created.

Specific examples of the fogging agents which are effective in the present invention are illustrated below. However, the present invention is not limited to the use of these compounds.

Compound 1

1-Formo-2-<3-{3-[4-(3-phenylthioureido)phenyl]-propionamido}-phenyl>hydrazide

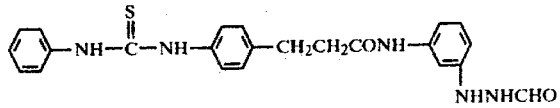

Compound 2

1-Aceto-2-<4-{3-[4-(3-ethylthioureido)phenyl]-propionamido}-phenyl>hydrazide

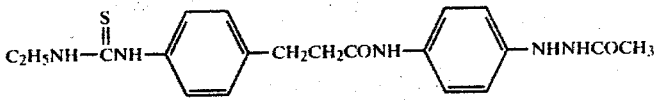

Compound 3

1-Aceto-2-{3-[m-(3-allylthioureido)cinnamido]-phenyl}hydrazide

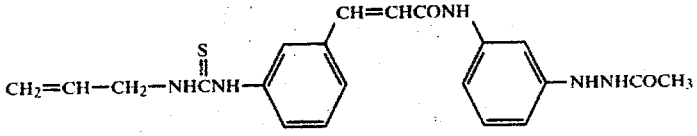

Compound 4

2-<4-{4-[4-(3-Cyclohexylthioureido)phenyl]-butanamido}-phenyl>-1-formo hydrazide

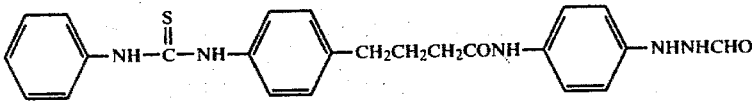

Compound 5

1-Formo-2-<4-{2-[4-(3-phenylthioureido)phenoxy]-acetamido}-phenyl>hydrazide

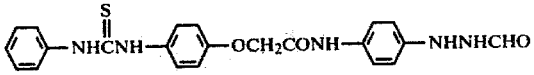

Compound 6

1-Formo-2-<4-{2-[3-(3-phenylthioureido)phenoxy]-acetamido}-phenyl>hydrazide

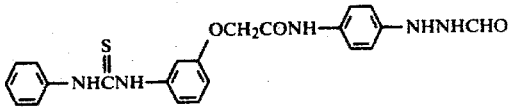

Compound 7

2-<4-{2-[4-(3-Ethylthiouredi)phenoxy]acetamido}-phenyl>-1-formohydrazide

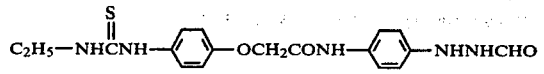

Compound 8

1-Aceto-2-<4-{2-[4-(3-phenylthioureido)phenoxy]-acetamido}phenyl>hydrazide

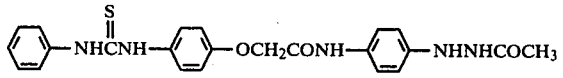

Compound 9

1-Benzo-2-<3-{2-[4-(3-methylthioureido)phenoxy]-acetamido}-phenyl>hydrazide

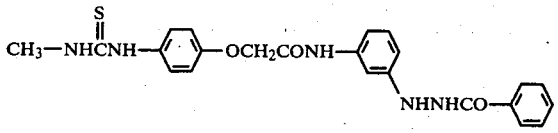

Compound 10

2-<4-{2-[4-(3-Phenylthioureido)phenoxy]-propionamido}phenyl>-1-formohydrazide

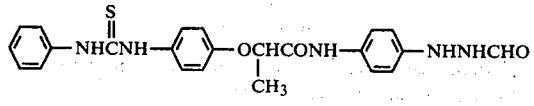

Compound 11

1-Formo-2-<4-{3-[4-(3-p-chlorophenylthioureido)-phenoxy]-propionamido}phenyl>hydrazide

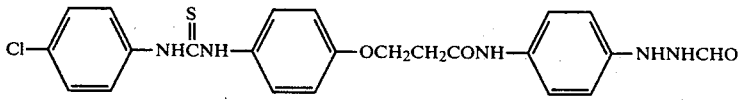

Compound 12

2-<4-{2-[3-(3-t-Butylthioureido)phenylthio]-acetamido}-phenyl>-1-formohydrazide

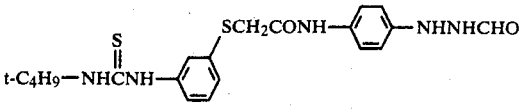

Compound 13

1-Propiono-2-<4-{3-[4-(3-phenylthioureido)-phenylthio]-propionamido}phenyl>hydrazide

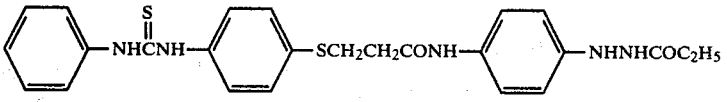

Compound 14

2-<4-{2-[4-(3-Allylthioureido)phenylthi-obutanamido}-phenyl>-1-formohydrazide

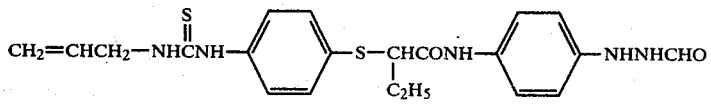

A general synthetic method for forming the fogging agent employed in the present invention is described below. By reacting 4- or 3-nitrophenylhydrazine with formic acid or a corresponding acid anhydride or acid chloride, 1-formo-2-(4- or 3-nitrophenyl)hydrazide or the corresponding 1-acylo-2-(4- or 3-nitrophenyl)hydrazide can be obtained. By catalytically reducing with hydrogen gas the nitrophenylhydrazine in a solvent such as an alcohol, for example, ethanol, methyl Cellosolve, etc. or dioxane, in the presence of palladium-carbon as a catalyst or by heating the nitrophenylhydrazine with reduced iron in an alcohol, a corresponding 4- or 3-aminophenylhydrazine can be obtained with ease. The 4- or 3-aminophenylhydrazine can be converted into a corresponding nitrophenyl-, nitrophenoxy- or nitrophenylthio-aliphatic acid amido phenylhydrazide by reacting it with a 4- or 3-nitrophenyl aliphatic acid chloride, 4- or 3-nitrophenoxy aliphatic acid chloride or 4- or 3-nitrophenylthio aliphatic acid chloride in the presence of an acid-eliminating agent. After converting the nitro group into an amino group by catalytic reduction or with reduced iron as described above, the amino compound is reacted with an arylisothiocyanate such as phenylisothiocyanate, etc. or an alkyl or alkenylisothiocyanate such as allylisothiocyanate, ethylisothiocyanate, etc. to obtain, the object compound.

Specific synthesis examples are illustrated below.

SYNTHESIS OF STARTING MATERIALS

Preparation 1

1-Formo-2-(4-nitrophenyl)hydrazide

To 1.6 l of acetonitrile was added 459 g of 4-nitrophenylhydrazine. Then, 322 g of formic acid was slowly added to the mixture to produce a homogeneous solution. Crystals precipitated 20 minutes later. After the reaction continued for another 2 hours at 80° C. inner temperature, the system was cooled. The crystals were removed by filtration and washed with acetonitrile. After drying, 493 g of 1-formo-2-(4-nitrophenyl)hydrazide was obtained; m.p.: 184°-186° C.

Preparation 2

1-Formo-2-(4-aminophenyl)hydrazide

In 1,600 ml of ethanol, 30 g of 1-formo-2-(4-nitrophenyl)hydrazide was catalytically reduced at room temperature in the presence of a palladium-carbon catalyst. The reaction liquid was filtered and the filtrate was evaporated to dryness to obtain 20.5 g of white solid 1-formo-2-(4-aminophenyl)hydrazide; m.p.: 123°-125° C.

Preparation 3

1-Formo-2-(3-nitrophenyl)hydrazide

3-Nitrophenylhydrazine instead of 4-nitrophenylhydrazine was reacted in a manner similar to Preparation (1) above to obtain 430 g of 1-formo-2-(3-nitrophenyl)-hydrazide; m.p.: 168°-169° C.

Preparation 4

1-Formo-2-(3-aminophenyl)hydrazide

1-Formo-2-(3-nitrophenyl)hydrazide was reacted in a manner similar to Preparation (2) above to obtain 21.0 g of 1-formo-2-(3-aminophenyl)hydrazide; m.p.: 108°-113° C.

Preparation 5

1-Benzo-2-(4-nitrophenyl)hydrazide

In 200 ml of benzene was dissolved 30 g of 4-nitrophenylhydrazine and 45 g of anhydrous benzoic acid. The solution was heated under reflux for 3 hours. The reaction solution was poured into ice water. The resulting product was taken out by filtration, washed with ethanol and dried to obtain 40 g of 1-benzo-2-(4-nitrophenyl)hydrazide; m.p.: 194°-196° C.

Preparation 6

1-Benzo-2-(4-aminophenyl)hydrazide

1-Benzo-2-(4-nitrophenyl)hydrazide was catalytically reduced in a manner similar to Preparation (2) above to obtain 22 g of 1-benzo-2-(4-aminophenyl)hydrazide; m.p.: 135°-137° C.

Preparation 7

1-Formo-2-{4-[3-(4-nitrophenoxy)propionamido]-phenyl}-hydrazide 127 g of 3-(4-nitrophenoxy)propionic acid and 120 g of thionyl chloride were reacted by heating under reflux for 30 minutes. The excessive thionyl chloride was removed by an azeotropic distillation with benzene from the reaction mixture. The reaction mixture was added to a mixture of 75.5 g of 2-(4-aminophenyl)-1-formohydrazide, 61 g of triethylamine and 600 ml of acetonitrile while maintaining the inner temperature below 10° C. After the reaction was carried out for 2 hours at room temperature and further stirred for 30 minutes at 50° C., the reaction was cooled and then poured into water. The resulting crystals were collected by filtration. Upon recrystallization from ethanol, 120 g of 1-formo-2-{4-[3-(4-nitrophenoxy)propionamido]phenyl}-hydrazide was obtained; m.p.: 117° to 118° C. (decomposed).

Preparation 8

1-Formo-2-{4-[2-(3-nitrophenoxy)acetamido]phenyl}-hydrazide

While heating under reflux 150 g of thionyl chloride was reacted with 102 g of 2-(3-nitrophenoxy)acetic acid for 1 hour. The excessive thionyl chloride was removed from the reaction mixture by an azeotropic distillation with benzene. The reaction mixture was added to a mixture of 75.5 g of 2-(4-aminophenyl)-1-formohydrazide, 60 g of triethylamine and 600 ml of acetonitrile while maintaining the inner temperature below 10° C. After stirring at 50° C. for 1 hour, the reaction mixture was cooled and then poured into water. The resulting crystals were collected by filtration. Upon recrystallization from ethanol 61.8 g 1-formo-2-{4-[2-(3-nitrophenoxy)acetamido]phenyl}hydrazide; m.p.: 163° to 165° C. (decomposed).

SYNTHESIS OF FOGGING AGENTS ACCORDING TO THE PRESENT INVENTION

Preparation 9

Synthesis of Compound 7

A mixture of 500 ml of methyl Cellosolve, 50 ml of water, 7 g of ammonium chloride and 16.5 g of 1-formo-2-{4-[2-(4-nitrophenoxy)acetamido]phenyl}hydrazide was heated on a steam bath while stirring. To the mixture was added 70 g of reduced iron. The mixture was heated for 4 hours with stirring. The reaction liquid was filtered and to the filtrate was added 8.7 g of ethyl isothiocyanate. The mixture was reacted at 60° to 70° C. for 3 hours. After cooling, the reaction liquid was poured into 3 liters of water. The resulting crystals were collected by filtration. Upon recrystallization from acetonitrile, 4 g of the object compound was obtained; m.p.: 177° to 178° C. (decomposed).

Synthesis of Compound 10

A mixture of 200 ml of isopropyl alcohol, 20 ml of water, 2 g of ammonium chloride and 20 g of iron powder was heated on a steam bath while stirring. To the mixture was added 12 g of 1-formo-2-{4-[2-(4-nitrophenoxy)-propionamido]phenyl} hydrazide. The mixture was heated under reflux for 40 minutes. The reaction liquid was filtered and to the filtrate was added 11 g of phenyl isothiocyanate. The mixture was reacted at 50° C. for 2 hours. After cooling, the crystals precipitated were collected by filtration. Upon recrystallization from 300 ml of ethanol, 8 g of the object compound was obtained; m.p.: 145° to 146° C. (decomposed).

Preparation 11

Synthesis of Compound 4

A mixture of 350 ml of isopropyl alcohol, 35 ml of water, 4 g of ammonium chloride and 40 g of reduced iron was heated on a steam bath while stirring. To the mixture was added 14 g of 1-formo-2-{4-[4-(4-nitrophenyl)-butanamide]phenyl}hydrazide. The mixture was heated under reflux for 1 hour. The reaction liquid was filtered while hot and then to the filtrate was added 12 g of cyclohexyl isothiocyanate. The mixture was reacted at 60° C. for 3 hours. The crystals precipitated were collected by filtration. Upon recrystallization from acetonitrile, 10 g of the object compound was obtained.

The other compounds can be synthesized in a manner similar to the above synthesis examples.

In the direct positive light-sensitive material of the present invention, it is preferred that the compound represented by the formula (I) be incorporated into the internal latent image type silver halide emulsion, however, the compound can also be incorporated into a hydrophilic colloid layer contiguous to the internal latent image type silver halide emulsion layer. Such a layer can be any layer of a light-sensitive layer, an intermediate layer, a filter layer, a protective layer, an antihalation layer, etc., having any function, as long as the fogging agent is not prevented from diffusing into the internal latent image type silver halide emulsion.

It is desired that the fogging agent of the present invention in layers be present in an amount that gives a suitable maximum density (for example, above 2.0) when the internal latent image type emulsion is developed by a surface developing solution. For practical purposes, the appropriate content will vary over a wide range depending upon the characteristics of silver halide emulsion, the chemical structure of the fogging agent and the developing conditions. Nevertheless, a range of from about 0.1 mg to 1,000 mg per mol of silver halide in the internal latent image type silver halide emulsion is practically effective, preferably about 0.5 mg to about 700 mg per mol of silver halide. Where the fogging agent is incorporated into the hydrophilic colloid layer contiguous to the emulsion layer, it is adequate to incorporate the fogging agent in an amount the same as above based on the amount of silver contained in the same area of the associated internal latent image type emulsion layer.

Internal latent image type silver halide emulsions are already shown by Davey et al (U.S. Pat. No. 2,592,250) and described in other references. The internal latent image type silver halide emulsion can be clearly distinguished by the fact that the maximum density achieved in the case of developing it with an "internal type" developing solution is greater than the maximum density achieved in the case of developing it with a "surface type" developing solution. The internal latent image type emulsion which is suitable for the present invention has a maximum density (measured by an ordinary photographic density measurement methods) when coated onto a transparent support and exposed to light a fixed time period of between 0.01 to 1 second and then developed with Developing Solution A indicated below (an internal type developing solution) at 20° C. for 3 minutes, greater by at least 5 times than the maximum density obtained in the case of developing the silver halide exposed as described above with Developing Solution B indicated below (a surface type developing solution) at 20° C. for 4 minutes.

| Developing Solution A: | |
|---|---|
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |

| Developing Solution B: | |
|---|---|
| p-Oxyphenylglycine | 10 g |
| Sodium Carbonate | 100 g |
| Water to make | 1 l |

As internal latent image type emulsions which are suitable for the objects of the present invention, there can be employed the emulsions described in British Pat. No. 1,027,146, U.S. Pat. Nos. 3,206,313, 3,511,662, 3,447,927, 3,737,313, 3,761,276, 3,271,157, etc., in addition to the emulsion described in U.S. Pat. No. 2,592,250 referred to above. However, the emulsions of the present invention are not limited to these.

As explained above a variety of direct positive photographic techniques are known including the use of silver halide grains which have been previously fogged and the use of internal latent image type silver halides which have not been previously fogged. The latter is preferred in the present invention because in this case the silver halide which has not been fogged provides higher sensitivity.

In the direct positive photographic light-sensitive material of the present invention, a variety of hydrophilic colloids can be employed as a binder.

As colloids employed for this purpose, there can be listed hydrophilic colloids conventionally employed in the photographic field, such as gelatin, colloidal albumin, polysaccharides, cellulose derivatives, synthetic resins, polyvinyl compounds including, e.g., polyvinyl alcohol derivatives, acrylamide polymers, etc. Hydrophobic colloids, e.g., dispersed polymerized vinyl compounds, particularly those that increase dimensional stability of photographic materials, can also be incorporated together with the hydrophilic colloid. Suitable examples of this type of compounds include water-insoluble polymers prepared by polymerizing vinyl monomers such as alkyl acrylates, alkyl methacrylates, acrylic acid, sulfoalkyl acrylates, sulfoalkyl methacrylates, etc.

A variety of photographic supports can be employed in the light-sensitive material of the present invention. The silver halide emulsion can be coated onto one side or both sides of the support.

In the light-sensitive material of the present invention, the photographic silver halide emulsion layers and other hydrophilic colloid layers can be hardened with an appropriate hardening agent. Examples of these hardening agents include vinylsulfonyl compounds as described in Japanese patent applications (OPI) Nos. 76,025/1978, 76,026/1978 and 77,619/1978, hardening agents having active halogen, dioxane derivatives, oxypolysaccharides such as oxy starch, etc.

The photographic silver halide emulsion layer can contain other additives, particularly those useful for photographic emulsion, e.g., lubricants, stabilizers, sensitizers, light absorbing dyes, plasticizers, etc.

In addition, in the present invention, compounds which release iodine ions (such as potassium iodide) can be incorporated into the silver halide emulsion, and furthermore, the desired image can be obtained using a developing solution containing iodine ions.

The light-sensitive material of the present invention can contain surface active agents for a variety of purposes. Depending upon purpose, any one of nonionic, ionic and amphoteric surface active agents can be employed, which are exemplified by, e.g., polyoxyalkylene derivatives, amphoteric amino acids (including sulfobetaines), etc. Examples of such surface active agents are described in U.S. Pat. Nos. 2,600,831, 2,271,622, 2,271,623, 2,275,727, 2,787,604, 2,816,920 and 2,729,891, Belgian Pat. No. 652,862, etc.

In the light-sensitive material of the present invention, the photographic emulsion can be spectrally sensitized with sensitizing dyes to blue light of relatively long wavelengths, green light, red light or infrared light. As sensitizing dyes, there can be employed, cyanine dyes, merocyanine dyes, complex cyanine dyes, complex merocyanine dyes, holopolar cyanine dyes, styryl dyes, hemicyanine dyes, oxonol dyes, hemioxonol dyes, etc.

Useful sensitizing dyes which can be employed in accordance with the present invention are described in, for example, U.S. Pat. Nos. 3,522,052, 3,619,197, 3,713,828, 3,615,643, 3,615,632, 3,617,293, 3,628,964, 3,703,377 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese patent application (OPI) No. 76,525/1973, Belgian Pat. No. 691,807, etc.

The sensitizing dyes employed in the present invention are used in a concentration almost equivalent to that used in ordinary negative silver halide emulsion. In particular, it is advantageous that the sensitizing dyes be employed in a dye concentration to a degree that does not substantially cause desensitization in the region of intrinsic density of silver halide emulsion. It is preferred that the sensitizing dyes be employed in a concentration of about $1.0\times10^{-5}$ to about $5\times10^{-4}$ mol per mol of silver halide, particularly in a concentration of about $4\times10^{-5}$ to $2\times10^{-4}$ mol per mol of silver halide.

Dye image-forming couplers can be incorporated into the light-sensitive material of the present invention. Alternatively, the light-sensitive material can also be developed with a developing solution containing a dye image-forming coupler. In order to incorporate a color forming agent into the silver halide emulsion of the present invention, known methods can optionally be employed. For example, methods as described in U.S. Pat. Nos. 1,055,155, 1,102,028, 2,186,849, 2,322,027 and 2,801,171 can be employed. In the present invention, developing agents, e.g., polyhydroxybenzenes, aminophenols, 3-pyrazolidones, etc., can also be incorporated in emulsion or light-sensitive material. In the present invention, the photographic emulsion can be unhardened, or can also contain tanning developing agents such as hydroquinone, catechol, etc.

The photographic emulsion of the present invention can also be utilized for obtaining desired transfer images on an image-receiving layer after appropriate development processing, in combination with a dye image-providing material for diffusion transfer capable of releasing diffusible dyes in response to development of silver halide. As such a dye image providing material for diffusion transfer, a number of compounds are known and such as the compounds described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, Published U.S. patent application No. 351/673, British Pat. Nos. 840/731, 904,364 and 1,038,331, German patent applications (OLS) Nos. 1,930,215, 2,214,381, 2,228,361, 2,317,134 and 2,402,900, French Pat. No. 2,284,140, Japanese patent application (OPI) No. 113,624/1976 (corresponding to U.S. Pat. No. 4,055,428) and Japanese patent application (OPI) No. 104,343/1976, Japanese patent applications Nos. 64,533/1977 and 58,318/1977, etc. can be employed. Of these, it is preferred that dye image providing materials of type which are first non-diffusible and, after the oxidation-reduction reaction with the oxidation product of the developing agent, cleave to release diffusible dyes (hereafter, referred to as DRR compounds) be employed.

In particular, preferred compounds for use in combination with the fogging agent of the present invention are DRR compounds having an o-hydroxyarylsulfamoyl group as described in the aforementioned U.S. Pat. No. 4,055,428 or DRR compounds having a redox mother nucleus as described in the above mentioned Japanese Patent Application (OPI) No. 64,533/1977 corresponding to U.S. patent application Ser. No. 911,571 filed June 1, 1978. If the fogging agent is employed in combination with such DRR compounds, the temperature dependency of processing is markedly reduced.

Specific examples of DRR compounds include, in addition to those as described in the above-described patent publications, 1-hydroxy-2-tetramethylenesulfamoyl-4-[3'-methyl-4'-(2''-hydroxy-4''-methyl-5''-hexadecyloxyphenylsulfamoyl)phenylazo]naphthalene as a magenta dye-forming substance, 1-phenyl-3-cyano-4-{3'-[2'-hydroxy-4''-methyl-5''-(2''',4'''-di-t-pentylphenoxyacetamino)phenylsulfamoyl]phenylazo}-5-pyrazolone as a yellow dye image-forming substance, etc.

For developing the light-sensitive material of the present invention, a variety of known developing agents can be employed. That is, polyhydroxybenzenes, e.g., hydroquinone, 2-chlorohydroquinone, 2-methylhydroquinone, catechol, pyrogallol, etc.; aminophenols, e.g., p-aminophenol, N-methyl-p-aminophenol, 2,4-diaminophenol, etc.; 3-pyrazolidones, e.g., 1-phenyl-3-pyrazolidones, 4,4-dimethyl-1-phenyl-3-pyrazolidone, 5,5-dimethyl-1-phenyl-3-pyrazolidone, etc.; ascorbic acids, and the like can be employed singly or as combination thereof. In addition, to obtain dye images in the presence of dye-forming couplers, aromatic primary amine developing agents, preferably p-phenylenediamine type developing agents can be used. Specific examples thereof include 4-amino-3-methyl-N,N-diethylaniline hydrochloride, N,N-diethyl-p-phenylenediamine, 3-methyl-4-amino-N-ethyl-N-β-(methanesulfonamido)-ethylaniline, 3-methyl-4-amino-N-ethyl-N-(β-sulfoethyl)-aniline, 3-ethoxy-4-amino-N-ethyl-N-(β-sulfoethyl)aniline, 4-amino-N-ethyl-N-(β-hydroxyethyl)aniline. Such developing agents can be incorporated into alkaline processing compositions (processing element) or can also be incorporated into appropriate layers of the light-sensitive element.

In the case of using DRR compound in the present invention, any silver halide developing agent can be employed as long as the agent is able to cross-oxidize the DRR compounds.

The developing agent can contain, as a preservative, sodium sulfite, potassium sulfite, ascorbic acid, reductones (e.g., piperidinohexose reductone), etc.

The light-sensitive material of the present invention can provide direct positive images by developing the material using a surface developing solution. The surface developing solution induces the development process substantially with latent images or fogging nuclei present on the surface of silver halide grains. Though it is preferred not to contain any silver halide dissolving agent in the developing solution, a small amount of the silver halide dissolving agent (e.g., sulfites) can be contained in the developing solution as long as internal latent images do not substantially contribute to development until the development due to the surface development center of silver halide grains is completed.

The developing solution can contain, as an alkali agent and a buffering agent, sodium hydroside, potassium hydroxide, sodium carbonate, potassium carbonate, trisodium phosphate, sodium metaborate, etc. The amount of these agents is selected so as to render the pH of the developing solution to 10 to 13, preferably pH to 11 to 12.5.

The developing solution can also contain color development accelerators such as benzyl alcohol, or the like. Further, it is advantageous that the developing solution contains, in order to lessen the reduction in the minimum density of direct positive images, compounds which are usually employed as anti-fogging agents, for example, benzimidazoles, e.g., 5-nitrobenzimidazole; benzotriazoles, e.g., benzotriazole, 5-methylbenzotriazole, etc.

The light-sensitive material of the present invention can also be processed with a viscous developing solution.

The viscous developing solution is a liquid state composition in which processing components necessary for development of silver halide emulsion and for formation of diffusion transfer dye images are contained; a major component of the solvent is water and in addition thereto, hydrophilic solvents such as methanol, methyl Cellosolve, etc., are contained therein in some cases. The processing composition contains an alkali in an amount sufficient to maintain pH necessary for developing the emulsion layer(s) and to neutralize acids (e.g., hydrohalic acids such as hydrobromic acid, carboxylic acids such as acetic acid, etc.) formed during various processings for development and formation of dye images. As alkalis, there may be employed alkali metal or alkaline earth metal salts, or amines such as lithium hydroxide, sodium hydroxide, potassium hydroxide, calcium hydroxide dispersion, hydroxylated tetramethyl ammonium, sodium carbonate, trisodium phosphate, diethylamine, etc. It is desired that alkali hydroxides be incorporated in the developing solution in such an amount as having a pH of preferably about 12 or more at room temperature, more preferably a pH of 14 or more for color diffusion transfer photography. More preferably, the processing composition contains hydrophilic polymers of high molecular weight, such as polyvinyl alcohol, hydroxyethyl cellulose, sodium carboxymethyl cellulose. It is desired that these polymers be employed so as to impart viscosity above 1 poise at room temperature preferably several hundreds (500 to 600) to 1,000 poise, to the processing composition.

Further, it is advantageous particularly in the case of a mono sheet film unit that the processing composition contain light absorbing agents such as $TiO_2$, carbon black, pH-indicating dyes for preventing the silver halide emulsion from fogging due to outside light during or after processing, or desensitizers as described in U.S. Pat. No. 3,579,333. In addition, developing inhibitors such as benzotriazole can be incorported into the processing composition.

It is preferred that the above-described viscous processing composition be employed in a rupturable container as described in U.S. Pat. Nos. 2,543,181, 2,643,886, 2,653,732, 2,723,051, 3,056,491, 3,056,492, 3,152,515, etc.

Where the light-sensitive material of the present invention is employed for diffusion transfer photography, it is peferred that the light-sensitive material be in the form of a film unit. A photographic film unit, that is, a film unit designed so as to enable processing by passing the film unit between a pair of side-by-side disposed pressing materials basically comprises the three elements below:

(1) a light-sensitive element containing the fogging agent of the present invention, (2) an image receiving element, and (3) the processing element; e.g., which contains a means for releasing the alkaline processing composition in the film unit such as a rupturable container and contains the silver halide developing agent.

A preferred embodiment of this photographic film unit is a type unified by laminating and the type disclosed in Belgian Pat. No. 757,959. According to this embodiment, the film unit comprises a transparent support having coated thereon, in succession, an image receiving layer, a substantially opaque light reflective layer (e.g., a $TiO_2$ layer and a carbon black layer), and a light-sensitive element comprising single or plural silver halide light-sensitive layers in combination with DRR compounds, and further thereon laminated a transparent cover sheet. A rupturable container containing an alkaline processing composition comprising an opacifying agent (e.g., carbon black) is disposed adjacent to the outermost layer of the above-described light-sensitive layers and the transparent cover sheet. Such a film unit is exposed to light through the transparent cover sheet; upon taking the unit out of a camera, the container is ruptured by the pressing materials to thereby develop the processing composition (containing the opacifying agent) is spread over the entire surface between a protective layer on the light-sensitive layers and the cover sheet. By doing this, the film unit is shielded from light as development proceeds. It is preferred that a neutralizing layer and further, if necessary, a neutralizing rate controlling layer (timing layer) be coated, in succession, onto a support of the cover sheet.

In addition, other useful embodiments utilizing laminate layers in which DRR compounds or diffusible dye releasing couplers are employed are described in U.S. Pat. Nos. 3,415,644, 3,415,645, 3,415,646, 3,647,487 and 3,635,707, German patent application (OLS) No. 2,426,980, etc.

The present invention will be further explained by reference to the examples below. However, the present invention is not limited thereto.

EXAMPLE 1

Onto a polyethylene terephthalate transparent support were coated in succession the following layers below to prepare four kinds of light-sensitive sheets (A) to (D).

(1) mordant layer containing the polymer (3.0 g/m$^2$) described in U.S. Pat. No. 3,898,088 and having the repeating unit indicated below:

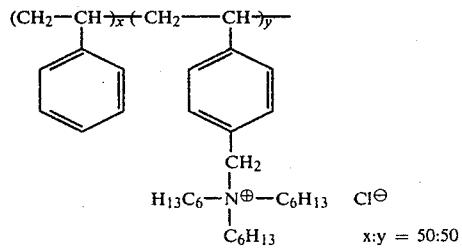

and gelatin (3.0 g/m$^2$)

(2) white reflective layer containing 20 g/m$^2$ of titanium oxide and 2.0 g/m$^2$ of gelatin.

(3) light-shielding layer containing 2.70 g/m$^2$ of carbon black and 2.70 g/m$^2$ of gelatin.

(4) layer containing the magenta DRR compound (0.45 g/m$^2$) indicated below, diethyllaurylamide (0.10 g/m²), 2,5-di-t-butylhydroquinone (0.0074 g/m²) and gelatin (0.76 g/m²).

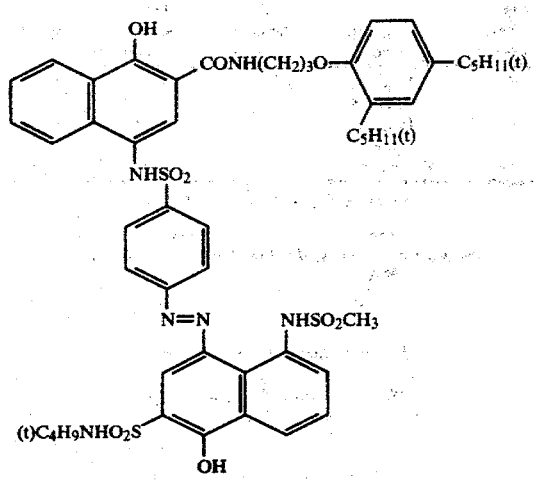

(5) layer containing green sensitive internal latent image type direct positive silver iodo bromide emulsion (internal latent image type emulsion prepared in the same manner as described in U.S. Pat. No. 3,761,276; halide composition in the silver halide: 2 mol% iodide; 1.4 g/m² calculated as the amount of silver, 1.0 g/m² of gelatin), sodium 5-pentadecyl-hydroquinone-2-sulfonate (0.11 g/m²), and a fogging agent in an amount indicated below:

| | | | |
|---|---|---|---|
| Light-sensitive sheet (A) | none | | — |
| Light-sensitive sheet (B) | Compound 5 | 14.2 | mg/mol of Ag |
| Light-sensitive sheet (C) | Compound 6 | 13.1 | mg/mol of Ag |
| Light-sensitive sheet (D) | Compound 7 | 14.7 | mg/mol of Ag |

(6) layer of gelatin (0.95 g/m²)

The above-described light-sensitive sheets (A) to (D) were processed in combination with each element shown below.

| Processing Solution: | | |
|---|---|---|
| 1-Phenyl-4-methyl-4-hydroxymethyl-3-pyrazolidone | 10 | g |
| Methylhydroquinone | 0.18 | g |
| 5-Methylbenzotriazole | 4.0 | g |
| Sodium Sulfite (anhydrous) | 1.0 | g |
| Carboxymethyl Cellulose Na Salt | 40.0 | g |
| Carbon Black | 150 | g |
| Potassium Hydroxide (28% aq. soln.) | 200 | cc |
| $H_2O$ | 550 | cc |

0.8 g of the processing solution of the above composition was filled into each pressure rupturable container.

Cover Sheet

Onto a polyethylene terephthalate support were coated an acid polymer layer (neutralizing layer) containing 15 g/m² of polyacrylic acid (a 10 wt% aqueous solution having viscosity of about 1,000 cp), a neutralization timing layer containing 3.8 g/m² of acetyl cellulose (hydrolysis of 100 g of the acetyl cellulose forms 39.4 g of acetyl groups), and 0.2 g/m² of a styrene-maleic anhydride copolymer [composition (molar) ratio: styrene:maleic anhydride is about 60:40, molecular weight: about 50,000] thereon, to thereby prepare a cover sheet.

Processing Step

The above-described cover sheet was laminated on the above-described light-sensitive sheet. Exposure was performed through a color test chart from the cover sheet side. Thereafter, the processing solution described above was spread between both sheets in a thickness of 75 microns (with assistance of a pressure roller). The processing was carried out at 25° C. After processing, the green density of the images formed on the image-receiving layer was masured 1 hour after the processing through the transparent support of the light-sensitive sheet using a Macbeth reflection densitometer. The results thereof are shown in Table 1.

It is apparent from the results shown in Table 1 that the compounds of the present invention act as excellent fogging agents.

TABLE 1

| Light-Sensitive Element | $D_{max}$ | $D_{min}$ |
|---|---|---|
| A | 0.28 | 0.27 |
| B | 1.96 | 0.27 |
| C | 1.85 | 0.29 |
| D | 1.88 | 0.26 |

EXAMPLE 2

Onto a polyethylene terephthalate transparent support, the following layers were coated in succession to prepare a light-sensitive sheet (E).

(1) mordant layer same as in Example 1

(2) white reflective layer same as in Example 1

(3) light-shielding layer same as in Example 1

(4) layer containing a cyan DRR compound (0.5 g/m²) indicated below, diethyllauryl amide (0.25 g/m²) and gelatin (1.14 g/m²)

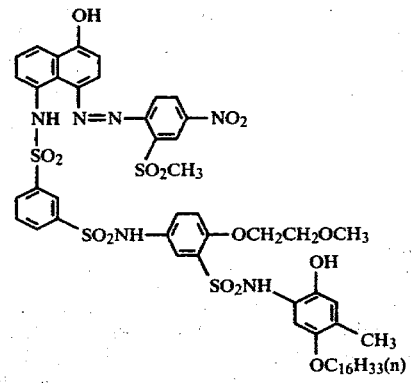

(5) layer containing red sensitive internal latent image type direct positive silver iodo bromide emulsion (internal latent image type emulsion prepared in accordance with the method described in U.S. Pat. No. 3,761,276; halide composition in the silver halide: 2 mol% iodide; 1.9 g/m² calculated as the amount of silver, 1.4 g/m² of gelatin), Fogging Agent A in the amount indicated in Table 2 below, and sodium 5-pentadecylhydroquinone-2-sulfonate (0.13 g/m²)

(6) layer containing gelatin (2.6 g/m²) and 2,5-di-octylhydroquinone (1.0 g/m²)

(7) a layer the same as layer (4) of Example 1 except containing the magenta DRR compound indicated below

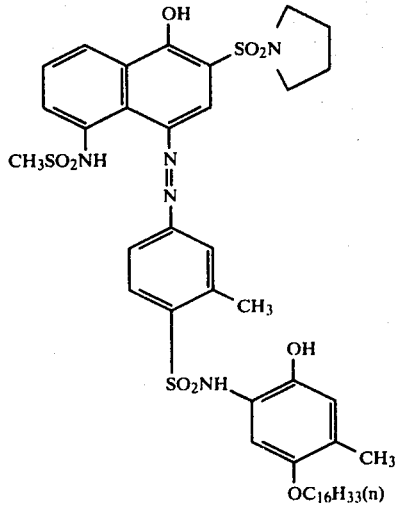

(8) a green sensitive internal latent image type direct positive emulsion layer as in Example 1 except containing Fogging Agent A in the amount indicated in Table 2 below.

(9) a layer same as layer (6) described above

(10) a layer containing the yellow DRR compound (0.78 g/m$^2$) indicated below, diethyllauryl amide (0.16 g/m$^2$), 2,5-di-t-butylhydroquinone (0.012 g/m$^2$) and gelatin (0.78 g/m$^2$)

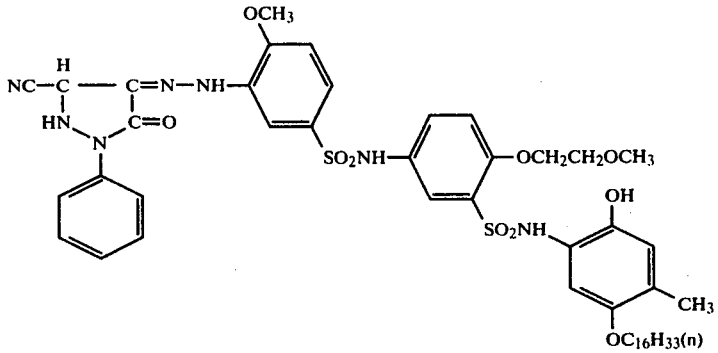

(11) layer containing blue sensitive internal latent image type direct positive silver iodo bromide emulsion (internal latent image type emulsion prepared in accordance with the method described in U.S. Pat. No. 3,761,276; halide composition in the silver halide: 2 mol% iodide; 2.2 g/m$^2$ calculated as the amount of silver, 1.7 g/m$^2$ of gelatin), Fogging Agent A (in an amount indicated in Table 2 below) and sodium 5-pentadecylhydroquinone-2-sulfonate (0.094 g/m$^2$)

(12) layer containing gelatin (0.94 g/m$^2$)

Further, light-sensitive sheets (F) and (G) were prepared in a manner similar to light-sensitive sheet (E) except that Fogging Agent B and Compound 6 of the present invention were employed instead of Fogging Agent A in the layers (5), (8) and (11) described above.

TABLE 2

| Light Sensitive Element | Fogging Agent | Amount Added (mg/l mol Ag) Blue Sensitive Layer | Green Sensitive Layer | Red Sensitive Layer |
|---|---|---|---|---|
| E | Fogging Agent A | 1,700 | 1,500 | 2,000 |
| F | Fogging Agent B | 10 | 9.5 | 12 |
| G | Compound 6 | 12.5 | 10 | 13.6 |

Fogging Agent A (for comparison)

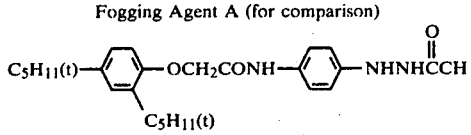

Fogging Agent B (for comparison)

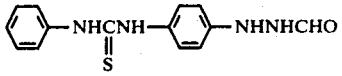

Compound 6 (this invention)

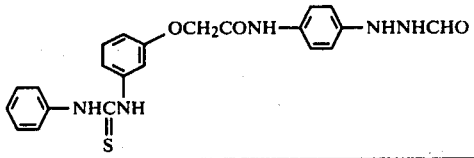

Processing Solution

The same processing solution used in Example 1.

Cover Sheet

Onto a polyethylene terephthalate support, the following coatings were applied in succession.

(1) In 1 kg of a 20% solution of an acrylic acid-butyl acrylate (8:2 in a molar ratio) copolymer having average molecular weight of 50,000 [solvent: acetone-water×3:1 (in a volume ratio)] was dissolved 3.8 g of (2-cyanoethylthio)-1-phenyltetrazole. The solution was coated in an amount of 110 g per 1 m$^2$ to obtain a layer having a thickness of about 20 microns.

(2) In an acetone-cyclohexane (3:1 in a volume ratio) solvent mixture were dissolved 55 g of cellulose acetate having acetylation degree of 52.1% (the weight of acetic acid released by hydrolysis was 0.521 g per 1 g of the sample), and 5 g of a styrene-maleic anhydride (1:1 in a molar ratio) copolymer having average molecular weight of 10,000. The solution so obtained was coated in an amount of 50 g per 1 $m^2$ to obtain a layer having a thickness of about 2.6 microns.

(3) Using a solution (10% solution as solid component) of a polymer latex obtained by emulsion-polymerizing styrene-butyl acrylate-acrylic acid in a weight ratio of 52:42:6, coating was made in an amount of 30 cc per 1 $m^2$.

Processing Step

The above-described cover sheet was laminated on the above-described light-sensitive sheet. Imagewise exposure was performed through a continuous gradation wedge from the cover sheet side. Thereafter, the above-described processing solution was spread in a thickness of 80 microns with the assistance of a pressure roller. The process was performed at 15° C., 25° C. and 35° C., respectively. After processing, the photographic properties of the color positive images obtained with the respective sheets are shown in Table 3.

TABLE 3

| Light-Sensitive Sheet | | Photographic Property $D_{max}$ 15° C. | $D_{max}$ 25° C. | $D_{max}$ 35° C. | $D_{min}$ 15° C. | $D_{min}$ 25° C. | $D_{min}$ 35° C. | Srel* 15° C. | Srel* 25° C. | Srel* 35° C. |
|---|---|---|---|---|---|---|---|---|---|---|
| | B* | 1.34 | 1.78 | 1.90 | 0.22 | 0.24 | 0.28 | 125 | 100 | 86 |
| E | G* | 1.49 | 1.83 | 2.00 | 0.24 | 0.23 | 0.29 | 120 | 100 | 81 |
| | R | 1.56 | 1.99 | 1.97 | 0.31 | 0.31 | 0.36 | 135 | 100 | 79 |
| | B | 1.78 | 1.62 | 1.64 | 0.23 | 0.23 | 0.27 | 93 | 100 | 109 |
| F | G | 1.83 | 1.73 | 1.71 | 0.25 | 0.27 | 0.27 | 72 | 100 | 113 |
| | R | 1.88 | 1.97 | 1.85 | 0.33 | 0.32 | 0.34 | 59 | 100 | 132 |
| | B | 1.62 | 1.58 | 1.69 | 0.24 | 0.25 | 0.28 | 92 | 100 | 109 |
| G | G | 1.65 | 1.66 | 1.68 | 0.22 | 0.23 | 0.26 | 90 | 100 | 106 |
| | R | 1.81 | 1.82 | 1.91 | 0.31 | 0.32 | 0.33 | 80 | 100 | 107 |

*Srel is a relative sensitivity and indicates a reciprocal value of the exposure amount required to obtain the ½ density of the sum of the maximum density and the minimum density.

** B, R and G each represents a blue sensitive layer, a green sensitive layer and a red sensitive layer.

As can clearly be seen from the results shown in the table above, Light-Sensitive Sheet G using Compound 6 in accordance with the present invention is less temperature-dependent during development in comparison to Light-Sensitive Sheets E and F using the known fogging agents. That is, when the fogging agent of the present invention was employed, the reduction in $D_{max}$ is small, as compared to when the fogging agent of Compound A type is used. In addition, variations in $D_{max}$ or Srel are markedly reduced with respect to the change in temperature during development. Furthermore, with the fogging agent of the present invention, the change in S rel in the G layer and R layer due to changes in temperature during development is markedly reduced, as compared to when the fogging agent of Compound B type is used.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic light-sensitive material comprising a support having coated thereon an unfogged internal latent image light-sensitive silver halide photographic emulsion layer and a hydrophilic colloid layer contiguous to said emulsion layer, at least one of said layers containing a compound represented by the formula (1)

$$R_1NH-\underset{\underset{S}{\|}}{C}NH-X_1-Y-CONH-X_2-NHNH\overset{\overset{O}{\|}}{C}-R_2 \quad (I)$$

wherein $R_1$ represents an alkyl group, an alkenyl group, a phenylene group or a naphthyl group; $R_2$ represents a hydrogen atom, an alkyl group, an alkenyl group, a phenylene group or a naphthyl group; $X_1$ and $X_2$, which may be the same or different, each represents a phenylene group or naphthylene group; and Y represents —R—, —O—R— or —S—R— wherein R represents an alkylene group and the O or S is bonded to $X_1$.

2. The direct positive silver halide photographic light-sensitive material of claim 1, wherein said light-sensitive silver halide photographic emulsion layer is associated with a diffusible dye releasing dye image.

3. The direct positive silver halide photographic light-sensitive material of claim 1, wherein said compound of the formula (I) is present in an amount which gives a suitable maximum density when the light-sensitive material is developed by a surface developing solution.

4. The direct positive silver halide photographic light-sensitive material of claim 1, wherein said compound of the formula (I) is present in an amount of about 0.1 mg to 1,000 mg per mol of silver halide.

5. The direct positive silver halide photographic light-sensitive material of claim 1, wherein said compound of the formula (I) is present in an amount of 0.5 mg to 700 mg per mol of silver halide.

6. The direct positive silver halide photographic light-sensitive material of claim 1, wherein said silver halide emulsion layer is sensitized to red, green or blue light.

7. The direct positive silver halide photographic light-sensitive material of claim 1, wherein said silver halide emulsion layer contains a sensitizing dye selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes.

8. The direct positive silver halide photographic light-sensitive material of claim 7, wherein said dye is present in an amount of $1.0\times10^{-5}$ to about $5\times10^{-4}$ mol per mol fo silver halide.

9. The direct positive silver halide photographic light-sensitive material of claim 1, wherein $R_1$ and $R_2$ in the formula (I) are an alkyl group or an alkenyl group.

10. The direct positive silver halide photographic light-sensitive material of claim 9, wherein $R_1$ and $R_2$ are an unsubstituted alkyl group or an alkyl group substituted with an alkoxy group, a halogen atom or an aryl group.

11. The direct positive silver halide photographic light-sensitive material of claim 1, wherein $R_1$ and $R_2$ are a phenyl group, a naphthyl group, or a phenyl or naphthyl group substituted with an alkyl group, an alkoxy group or a halogen atom.

12. The direct positive silver halide photographic light-sensitive material of claim 1, wherein $X_1$ and $X_2$ are a phenylene group, a naphthylene group or a phenylene group substituted with an alkyl group or a halogen atom.

13. The direct positive silver halide photographic light-sensitive material of claim 12, wherein $X_1$ and $X_2$ are a phenylene group.

14. The direct positive silver halide photographic light-sensitive material of claim 13, wherein the $$R_1NHC(=S)NH-$$

group is connected to the

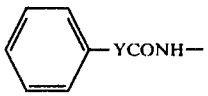

group at the meta or para position and the $$-NHNHC(=O)-R_2$$

group is connected with the

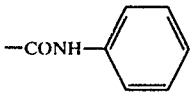

group at the meta or para position thereof.

15. The direct positive silver halide photographic light-sensitive material of claim 1, wherein the said light-sensitive silver halide photographic emulsion layer or adjacent hydrophilic colloid layer contains a diffusible dye-releasing dye image-providing material.

16. The direct positive silver halide photographic light-sensitive material of claim 1, wherein R contains a double bond or a triple bond.

17. The direct positive silver halide photographic light-sensitive material of claim 1, wherein said compound of the formula (I) is incorporated in said unfogged internal latent image light-sensitive silver halide photographic emulsion layer.

18. In a light-sensitive material for the diffusion transfer process comprising a light-sensitive element, an image receiving element and a processing element, the improvement which comprises: said light-sensitive element comprising a direct positive unfogged internal latent image light-sensitive silver halide emulsion layer and a hydrophilic colloid layer contiguous to said emulsion layer, at least one of said layers containing a compound represented by the formula (I):

$$R_1NH-CH(=S)N-X_1-Y-CONH-X_2-NHNHC(=O)-R_2 \quad (I)$$

wherein $R_1$ represents an alkyl group, an alkenyl group, a phenylene group or a naphthyl group; $R_2$ represents a hydrogen atom, an alkyl group, an alkenyl group, a phenylene group or a naphthyl group; $X_1$ and $X_1$, which may be the same or different, each represents a phenylene group or naphthylene group; and Y represents —R—, —O—R— or —S—R— wherein R represents an alkylene group and the O or S is bonded to X.

19. The light-sensitive material of claim 18, wherein said silver halide emulsion layer is associated with a dye releasing dye image providing material having an o-hydroxyarylsulfamoyl group.

20. The light-sensitive material of claim 18, wherein said diffusible dye releasing dye image providing material is a dye releasing redox compound or a diffusible dye releasing coupler.

21. The light-sensitive material of claim 18, wherein said compound of the formula (I) is present in an amount which gives a suitable maximum density when the light-sensitive material is developed by a surface developing solution.

22. The light-sensitive material of claim 18, wherein said compound of the formula (I) is present in an amount of about 0.1 mg to 1,000 mg per mol of silver halide.

23. The light-sensitive material of claim 18, wherein said compound of the formula (I) is present in an amount of 0.5 mg to 700 mg per mol of silver halide.

24. The light-sensitive material of claim 18, wherein said silver halide emulsion layer is sensitized to red, green or blue light.

25. The light-sensitive material of claim 18, wherein said silver halide emulsion layer contains a sensitizing dye selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes.

26. The light-sensitive material of claim 25, wherein said dye is present in an amount of $1.0\times10^{-5}$ to about $5\times10^{-4}$ mol per mol of silver halide.

27. The light-sensitive material of claim 18, wherein $R_1$ and $R_2$ in the formula (I) are an alkyl group or an alkenyl group.

28. The light-sensitive material of claim 27, wherein the alkyl group for $R_1$ and $R_2$ is an unsubstituted alkyl group or an alkyl group substituted with an alkoxy group, a halogen atom or an aryl group.

29. The light-sensitive material of claim 18, wherein $R_1$ and $R_2$ are a phenyl group, a naphthyl group, or a phenyl or naphthyl group substituted with an alkyl group, an alkoxy group or a halogen atom.

30. The light-sensitive material of claim 18, wherein $X_1$ and $X_2$ are a phenylene group, a naphthylene group or a phenylene group substituted with an alkyl group or a halogen atom.

31. The light-sensitive material of claim 30, wherein $X_1$ and $X_2$ are a phenylene group.

32. The light-sensitive material of claim 31, wherein the

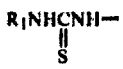

group is connected to the

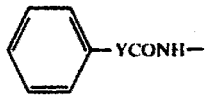

group at the meta or para position, and the

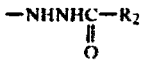

group is connected with the

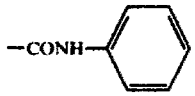

group at the meta or para position thereof.

33. The light-sensitive material of claim 18, wherein R contains a double bond or a triple bond.

34. The direct positive silver halide photographic material of claim 1, wherein said silver halide photographic emulsion layer is divided into a red sensitive silver halide emulsion layer, a green sensitive silver halide emulsion layer and a blue sensitive silver halide emulsion layer.

35. The light sensitive material of claim 18, wherein said silver halide emulsion layer is divided into a red sensitive silver halide emulsion layer, a green sensitive silver halide emulsion layer and a blue sensitive silver halide emulsion layer.

36. A direct positive silver halide photographic material of claim 34, wherein said red sensitive silver halide emulsion layer is associated with a cyan DRR compound, said green sensitive silver halide emulsion layer is associated with a magenta DRR compound and said blue sensitive silver halide emulsion layer is associated with a yellow DRR compound.

37. A light sensitive material of claim 35, wherein said red sensitive silver halide emulsion layer is associated with a cyan DRR compound, said green sensitive silver halide emulsion layer is associated with a magenta DRR compound and said blue sensitive silver halide emulsion layer is associated with a yellow DRR compound.

* * * * *